US006737985B1

(12) United States Patent
Garrard et al.

(10) Patent No.: US 6,737,985 B1
(45) Date of Patent: May 18, 2004

(54) REMOTE METERING

(75) Inventors: Peter Garrard, Christchurch (GB); Peter Hibbitt, Wimborne (GB)

(73) Assignee: Advanced Technology Ramar Limited, Christchurch (GB)

( * ) Notice: Subject to any disclaimer, the term of this patent is extended or adjusted under 35 U.S.C. 154(b) by 0 days.

(21) Appl. No.: 09/555,089

(22) PCT Filed: Dec. 15, 1998

(86) PCT No.: PCT/GB98/03749

§ 371 (c)(1),
(2), (4) Date: May 24, 2000

(87) PCT Pub. No.: WO99/31633

PCT Pub. Date: Jun. 24, 1999

(30) Foreign Application Priority Data

Dec. 16, 1997 (GB) ..... 9726567

(51) Int. Cl.[7] ..... G08C 15/06
(52) U.S. Cl. ..... 340/870.02; 370/346; 455/86
(58) Field of Search ..... 340/870.02, 870.03, 340/870.11; 370/346, 339, 341; 379/106.03; 455/86

(56) References Cited

U.S. PATENT DOCUMENTS 4,173,837 A * 11/1979 Kiejzik ..... 379/93
4,504,822 A 3/1985 Goizman
5,280,498 A 1/1994 Tymes et al.
6,246,677 B1 * 6/2001 Nap et al. ..... 370/346
6,441,723 B1 * 8/2002 Mansfield, Jr. et al. . 340/310.01

FOREIGN PATENT DOCUMENTS

GB 629098 A2 12/1994

* cited by examiner

*Primary Examiner*—Timothy Edwards, Jr.
(74) *Attorney, Agent, or Firm*—Emrich & Dithmar

(57) ABSTRACT

A meter for use in a radio frequency remote metering system comprises an antenna; a transmitter for transmitting meter signals via the antenna; a receiver connected to the antenna for receiving and filtering an incoming radio frequency signal; and a carrier signal detect circuit which is connected to receive the filtered radio frequency signal and which is operable to detect the presence or absence of a carrier signal, and to prevent activation of the transmitter in response to the presence of the carrier signal, to activate the transmitter in response to the absence of the said carrier signal.

11 Claims, 4 Drawing Sheets

| AT2051 PIN FUNCTIONS | | | |
|---|---|---|---|
| PIN DESIG | PIN FUNCTION | IN/OUT | ACTIVE HIGH/LOW |
| P3.0/RXD | RX COLLISION DET | IN | |
| P3.1/TXD | TRANSMIT DATA OUT | OUT | |
| P3.2/_INT0 | COUNT PULSE | IN | FALLING EDGE |
| P3.3/_INT1 | | | |
| P3.4 | 3 WIRE ENABLE (E) | OUT | |
| P3.5 | 3 WIRE CLK | OUT | |
| P3.7 | TX OUTPUT CONTROL | OUT | |
| P1.0 | 3 WIRE DAT | OUT | |
| P1.1 | PLL LOCKED | IN | |
| P1.2-1.6 | FREQ CONTROL | IN | |
| P1.7 | NON VOLATILE MEMORY | IN/OUT | |

REMOTE METERING

The present invention relates to remote metering and in particular to radio frequency transmitters suitable for remote metering applications.

Public and private utility distribution companies, for example water, gas and electricity distributors, are continuously exploring new ways to monitor service provision and to reduce costs. Increasing the number of times that readings from a particular meter are taken can improve the monitoring of the service. However, increased readings with current manual systems would result in higher costs due to the increased number of meter reading personnel that would be required.

Thus, it is desirable to provide utility meters, which can be remotely accessed, for example by way of a radio frequency (RF) communication system.

A previously considered remote metering system is shown schematically in FIG. 1, and comprises a number of remote meters 1 which communicate in groups to remote metering concentrators 2. The remote metering concentrators 2 are in turn connected to communicate with a central billing unit 3. In such systems, the remote meters 1 may ideally communicate with a remote meter concentrator 2 by way of a radio frequency communications link. The concentrators 2 can communicate with a gateway to the central billing unit 3 by way of a radio frequency link, a PSTN land line, or other wide area network.

One way of avoiding signal clash between remote units in the same group would be to provide a distinct channel for each remote meter in the group. This however would prove extremely costly, both in terms of money and bandwidth requirements. Reducing the number of remote meters in a group would decrease the number of channels required, but would mean that many more concentrators would be required, hence increasing the cost.

However, there is a problem associated with using radio frequency communications for such metering applications, because of the large number of meters involved, particularly in cities. Such large numbers of meters can easily lead to collision of the signals from adjacent meters, and hence lead to loss of data.

Previously considered systems have incorporated radio connections in which polling of remote meters takes place by the concentrator. The concentrator polls the meter to request information, and in reply the meter concerned returns the meter reading. This requires a complicated receiver and decoder to be provided in each meter.

According to a first aspect of the present invention, there is provided a meter for use in a radio frequency remote metering system, the meter comprising a transmitter for transmitting meter signals, a receiver for receiving and filtering an incoming radio frequency signal, and a carrier signal detection circuit, which is connected to receive the filtered radio frequency signal and which is operable to detect the presence or absence of a carrier signal, and to prevent activation of the transmitter in response to the presence of the carrier signal, and to activate the transmitter in response to the absence of the said carrier signal.

Preferably, the receiver can be provided with a local oscillator signal by the transmitter, and the transmitter output can be isolated from its antenna. The local oscillator frequency is preferably set differently to that required by the transmitter for transmission of a signal.

In one embodiment of the present invention, meter information is stored in a non-volatile memory. In an electricity meter embodying the present invention, the mains supply lines can provide the power supply for the meter.

According to a second aspect of the present invention, there is provided a remote metering system comprising a plurality of meter according to the first aspect of the invention, at least one remote meter concentrator for receiving signals from a predefined group of remote meters, and a central control unit for receiving signals from each remote meter concentrator.

The data from the meters is maintained at the concentrator, reducing the data traffic from the meters when a request for a reading comes from the utility. This is particularly necessary where the country regulations require a 20%/80% data flow on the license exempt frequency allocation between meters and concentrators.

Thus aspects of the present invention do not need to perform the process of poll, request and reply associated with previously considered systems.

Another problem associated with remote metering devices is the desirably small size of the meter housing, so that the meter is unobtrusive. This restricts the size of the antenna, which in turn can restrict the effective propagation range between the transmitters and receivers.

According to a third aspect of the present invention, there is provided a radio frequency transmitter system for use in a metering device, wherein a supply line of the metering device serves as an antenna for the transmitter.

One electricity meter embodying the third aspect of the present invention makes use of the earth supply line as an antenna.

Thus, the third aspect of the invention can provide a longer antenna than previously available for small meter applications. This leads to consequent improvements in propagation and performance.

For a better understanding of the invention, and to show how the same may be carried into effect, reference will now be made, by way of example, to the accompanying drawings, in which.

Figure 1:
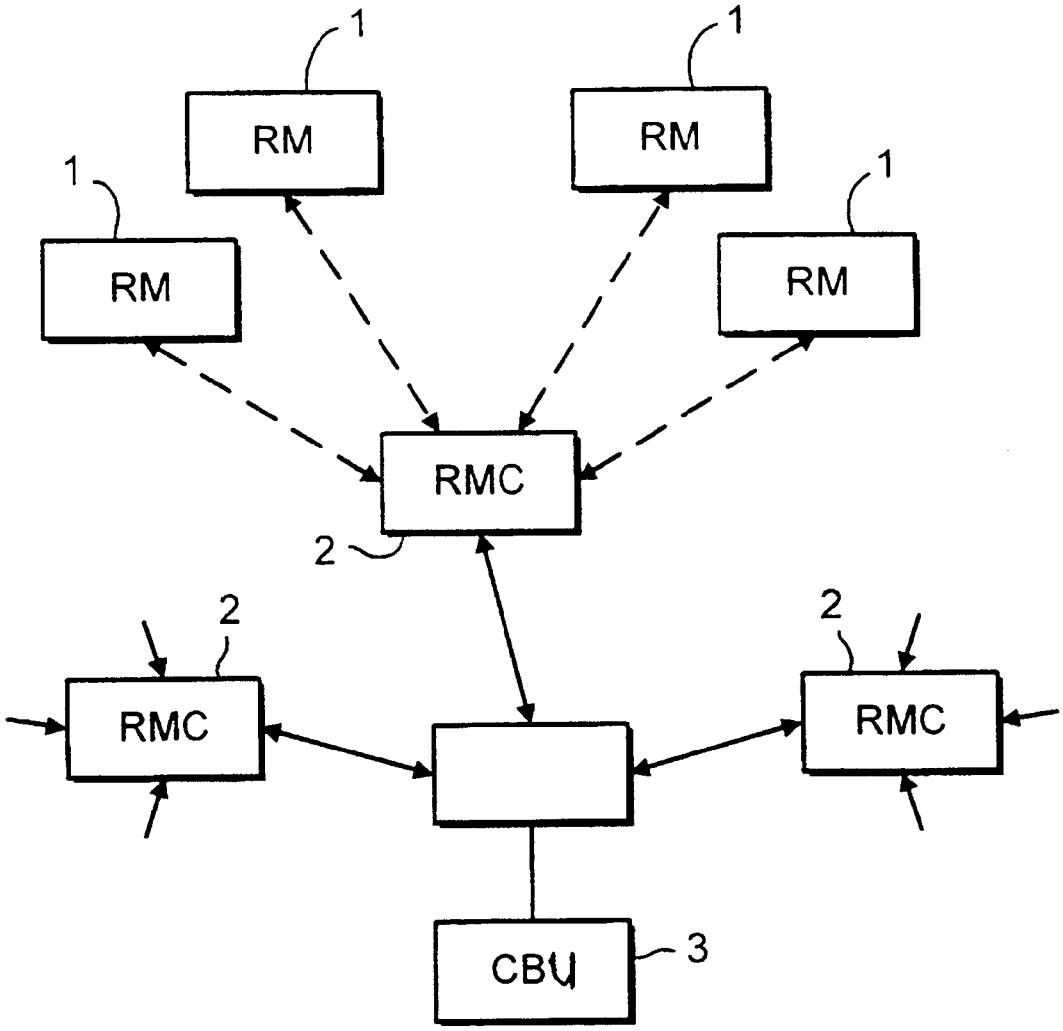
FIG. 1 shows a schematic block diagram of a remote metering system.

The overall scheme of the previously considered remote metering system of FIG. 1 can be used with embodiments of aspects of the invention.

Figure 2:
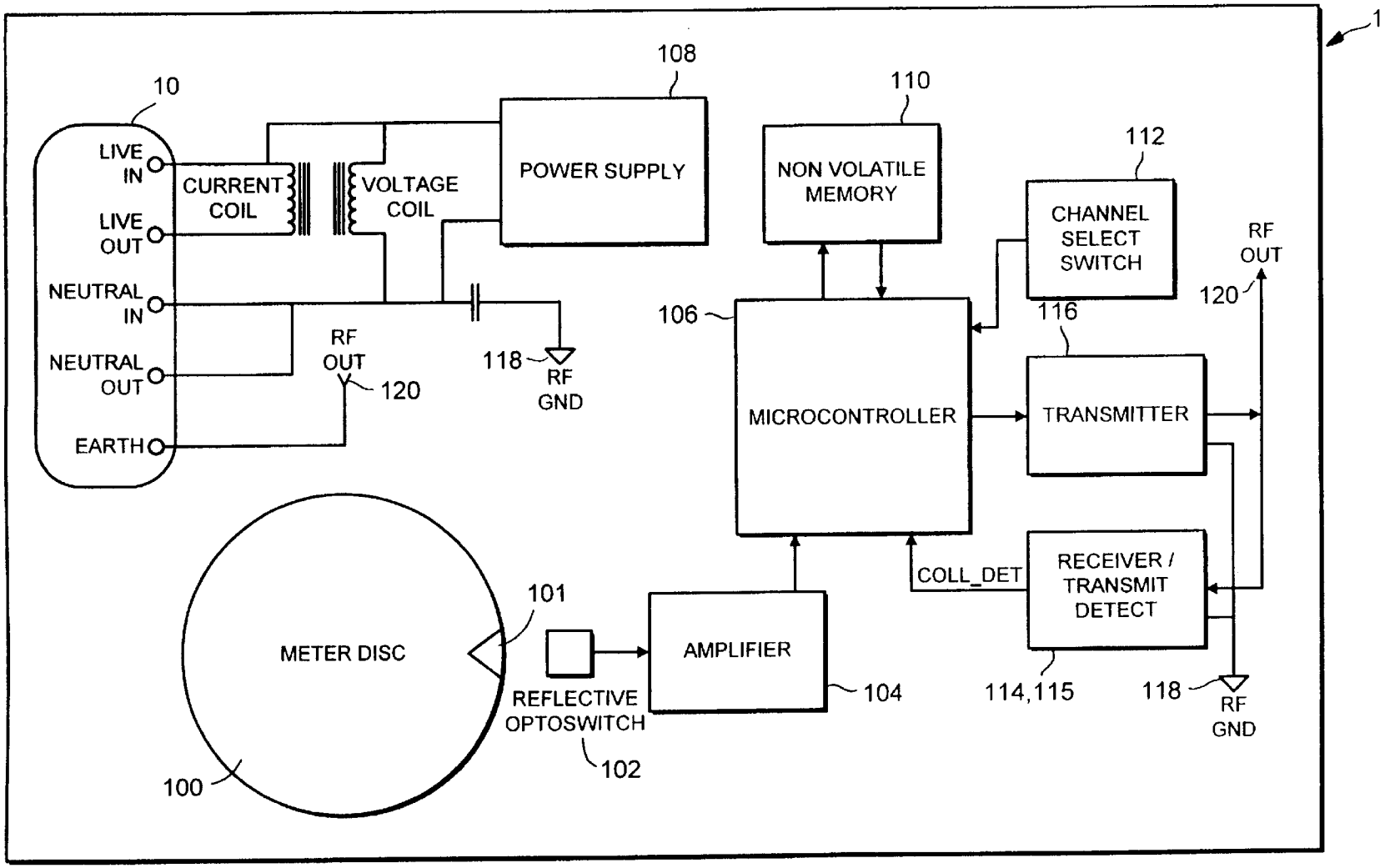
FIG. 2 shows a block diagram of a remote meter embodying the present invention.
Figure 3A:
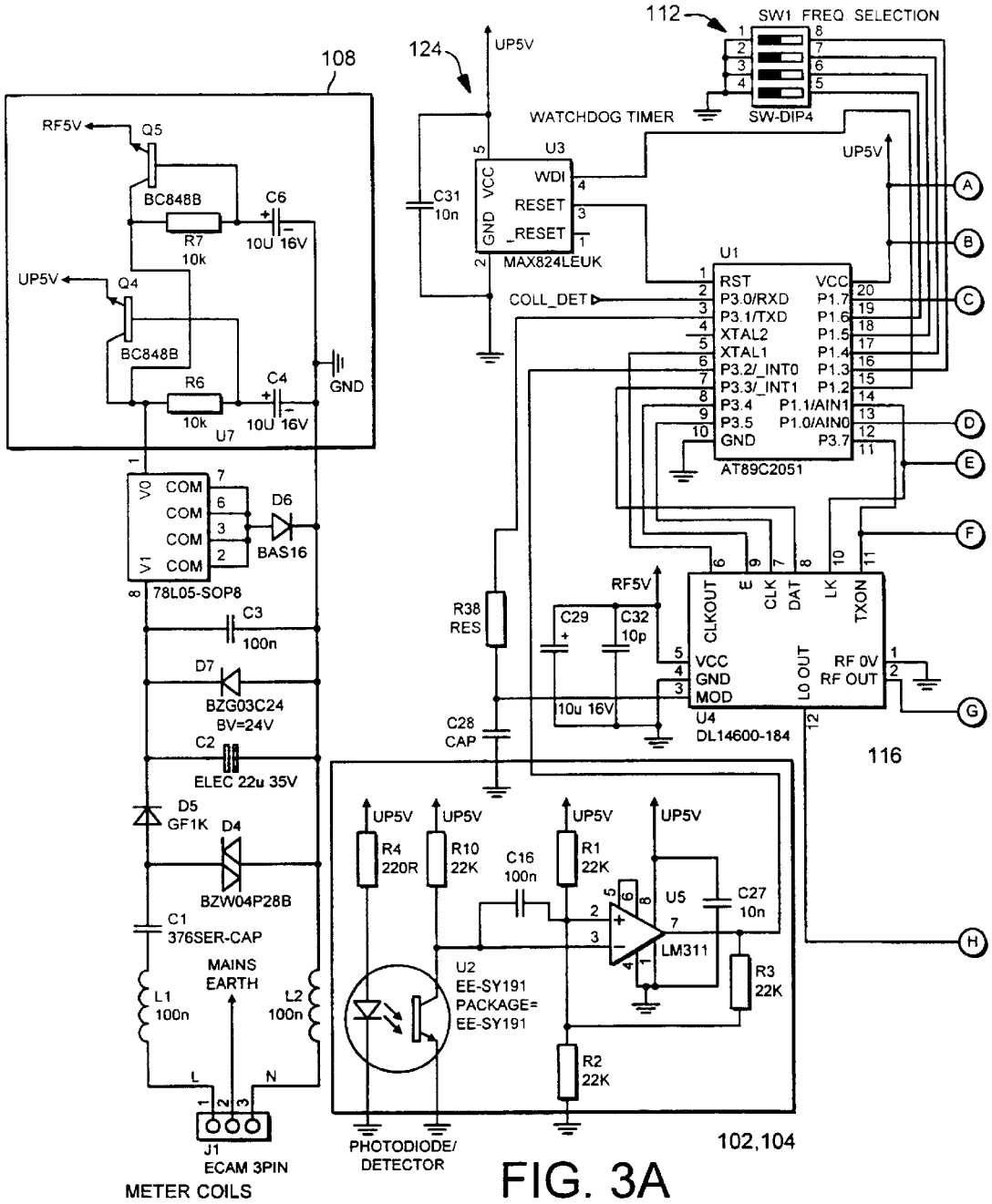
FIGS. 3A and 3B show a detailed circuit diagram of one specific design of remote meter embodying the present invention.
Figure 3B:
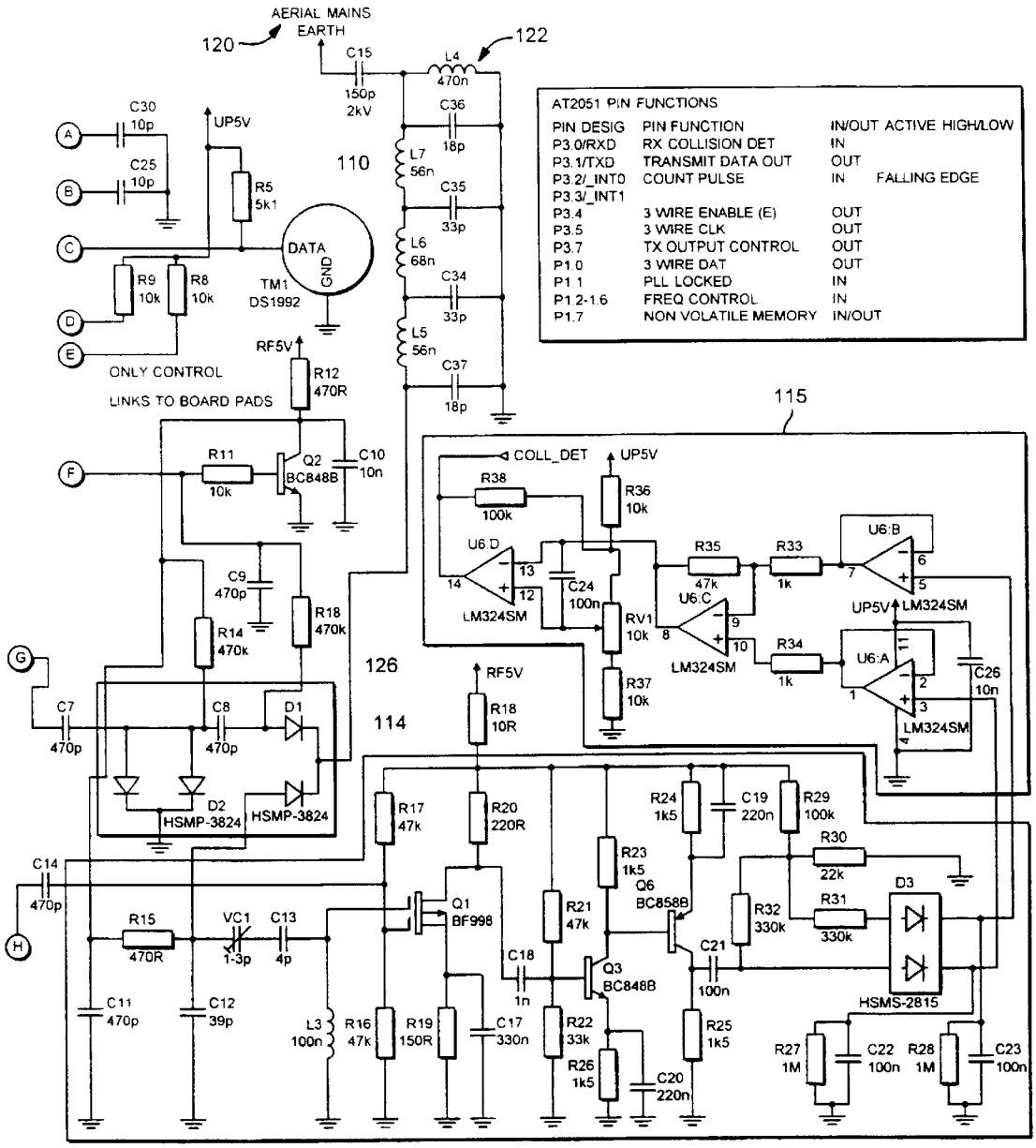

A remote-access electricity meter embodying the present invention is shown schematically in FIG. 2, and a specific example of such a meter is shown in detail in FIGS. 3A and 3B. The meter comprises electricity supply inputs and outputs 10 and a meter disc 100 which is caused to rotate when current flows through the electricity supply terminals. This aspect of the remote meter 1 is entirely conventional.

A power supply 108 is provided, and takes power from the voltage coil of the mains input. As shown in more detail in FIG. 3A, the power supply 108 provides two separate supply voltages for the processing and RF circuits (UP 5V and RF 5V respectively). In this way, these two circuits can be effectively isolated from one another in order to suppress noise transmission therebetween.

The meter disk 100 is provided with a mark, for example a black paint mark, which is used to detect rotation of the disk 100. A reflective opto-switch detector 102 is connected via a signal amplifier 104 to a micro-controller 106. The opto-switch 102 provides a pulse each time the mark passes the opto-switch 102. The opto-switch includes a light source, which produces a light beam, which is reflected by the face of disk 100. When the reflecting beam is broken by the paint mark, a pulse is produced.

The amplifier 104 amplifies and filters the pulse signal to provide a cleaned (debounced) signal to reduce the number of faulty readings produced by scratched paint, disk jitter, stopping on the paint mark, etc., a second sensor may be used for detection of reverse rotation of disc 100.

A micro-controller 106 operates to count and store a meter reading relating to the total pulse count. The reading is stored in non-volatile memory 110 so that it can be retained even when the electricity supply is interrupted.

When appropriate, the micro-controller 106 operates to transmit, via the transmitter 116 and antenna system 120, the currently stored meter reading to the appropriate remote meter concentrator 2 (FIG. 1).

Preferably, the meter can be assigned one of a number of different frequencies used in the concentrator group, for example a total of sixteen different channels can be provided in one concentrator group. This has the advantage that many meters can be provided which are arranged in cells and can be spaced apart in both time and frequency domains. A further function that becomes available from the software-programmed frequency is that if any frequency becomes blocked by faulty units, other users, etc., alternate channels are available.

In a particular embodiment of the invention, the transmitter can be centred on 183.875 MHz, and can have sixteen separate channels at 25 KHz spacing between 183.675 and 184.050 MHz. The channel selection is made by way of a channel select switch 112, or software selection, which is preferably a dual in-line switch package SW1.

The time at which the reading is transmitted can be controlled in any appropriate manner. For example, the meter reading can be transmitted on a specific RF channel at predetermined intervals, for example every three hours.

Alternatively, the channel selection and time of transmission for a particular transmitter could be chosen such that a particular channel is chosen for the particular time of transmission. For example channel one could be used during the first three minutes of every hour, channel two the next three minutes, etc. The other transmitters in the concentrator group could be allocated channels at different times to the first transmitter to provide effective time domain multiplexing.

Time domain multiplexing can be used to enable a concentrator to provide, for example, around 300 readings per hour, and each meter can for example transmit once every three hours.

Due to the high number of remote meters installed in a given area, particularly in a city, it is necessary to avoid collision of transmitting signals. The provision of a number of channels and the allocation of the channels can serve to reduce the chances of collision between transmitted signals. Naturally, it will be possible to have respective signals transmitted on all channels at the same time, but signals transmitted on the same channel at the same time from different remote meters will collide and data will probably be lost.

Accordingly, the remote meter 1 embodying the present invention incorporates a receiver 114 and a carrier detect circuit 115. The RF receiver 114 operates to receive and filter the incoming RF signal, and the carrier detect circuit 115 simply operates to detect the presence or absence of the carrier frequency for the channel on which the meter will transmit. In order to isolate the transmit detect circuit from spuriously detecting the transmitter circuit, the local oscillator of the transmitter is switched to a non-transmitting frequency (CH-1). This serves to prevent the transmitter producing a signal at the expected carrier frequency.

In addition, an output attenuator (126 in FIG. 3) is enabled and the radio frequency power amplifier of the transmitter is not powered. The attenuator is preferably provided by a PIN diode package. The receiver 114 receives a local oscillator signal from the transmitter in order to be able to search for signals. This simplifies the overall circuitry by reducing the number of local oscillators required for transmission and reception of the signal. The transmit detect circuit 115 is then able to detect reliably the presence of the carrier frequency of the channel concerned, and when this carrier frequency is not detected, the transmitter can be activated. In one embodiment, the detection circuit operates to detect any carrier signal within its bandwidth, thus simplifying the detection circuit considerably.

The micro-controller 106 receives an output signal (coll_det) from the transmit detect circuitry 115. A transmit control output TXON (from pin 3.7) of the micro-controller 106 switches the transmitter on and off.

When the transmitter is activated, the attenuator 126 is disabled, the RF power amplifier is powered, and the output data modulation sequence is provided to the transmitter. An output filter 122 serves to filter the modulated output signal before transmission to the antenna 120.

As shown in FIG. 3B, in one specific embodiment of the present invention uses a diode package D3 to detect the carrier signal. One half of D3 detects beat frequencies presented by the receiver, and the other half provides temperature and voltage compensation.

In the specific example shown in FIG. 3, the attenuator 126 is provided by diodes D1 and D2. The output of the transmitter amplifier can be blocked from the antenna by half of D1 and D2 while the transmitter local oscillator frequency is used by the receiver. The other half of D1 connects the antenna to the receiver. The functions of D1 and D2 can then be reversed in order to connect the transmitter output to the antenna.

The output data sequence comprises data for transmitting to the remote meter concentrator 2. Typically this sequence could include a preamble or header portion, data concerning the meter type and meter ID, total pulse count data (meter reading data), an error detection code and check sum, and finally a stop bit. The pure data sequence is preferably encoded into a high frequency digital modulation scheme which can provide robust communication and minimal data loss.

The non-volatile memory 110 can preferably store up to three pages of data, which can be used to correlate meter readings when the power supply is interrupted.

In preferred embodiments of the invention, the antenna 120 is provided by the mains earth connection. The radio frequency ground is provided by the neutral line of the mains supply. Using the mains supply lines in this way enables the effective length of the output antenna to be greatly increased over that possible within the confines of the meter housing. This is due to the fact that if an RF signal is applied to the mains supply lines, those lines act as an antenna up to the point at which the supply reaches the first earthing point or transformer. Thus, in a large building, virtually the whole of the mains supply system can be used as an antenna. This greatly improves the output of the transmitter.

The meter illustrated in FIGS. 2, 3A and 3B is an electricity meter, although the principle could of course be applied to water and gas meters, assuming that a power supply for the circuitry can be provided.

A remote metering system comprising a plurality of meter according to the first aspect of the invention, at least one remote meter concentrator for receiving signals from a predefined group of remote meters, and a central control unit for receiving signals from the or each remote meter concentrator.

A relay repeater system is usefully provided using a plurality of meters embodying the first aspect of the present invention, and at least on repeater to connect the meters to a remote meter concentrator. The repeaters are capable of re-transmitting the meter readings on any RF channel used by the concentrator or meter.

The concentrator may provide further functions when used as a simultaneous data pathway for other uses. It may be used for monitoring any Radio frequency linked devices that require to be monitored within the geographic environment covered by the combination of the concentrator and relay repeaters. One combination of the system links security systems and fire systems to the appropriate utility.

The combination provides full bi-directional communication of all such systems. For example meters may be switched off from the central utility database.

What is claimed is:

1. A remote metering system comprising:

a plurality of remote meters each of which includes an antenna, a transmitter for transmitting meter signals via the antenna, a receiver connected to the antenna for receiving and filtering an incoming radio frequency signal, and a carrier signal detection circuit which is connected to receive the filtered radio frequency signal and which is operable to detect the presence or absence of a carrier signal, and to prevent activation of the transmitter in response to the presence of a carrier signal, or to activate the transmitter in response to the absence of said carrier signals;

a plurality of concentrator units arranged for direct RF communication with respective groups of remote meters to receive respective meter data therefrom; and a central control unit arranged for communicating with the plurality of concentrator units for receiving meter data from the plurality of concentrator units, wherein the remote meters in a meter group are operable to initiate communication with the corresponding concentrator unit during respective predefined time periods; and wherein the receiver is provided with a local oscillator signal by the transmitter (116), the transmitter (116) output being isolated from the antenna (120) during such provision of the local oscillator signal.

2. A system as claimed in claim 1, wherein the local oscillator frequency is set differently to that required by the transmitter for transmission of a signal.

3. A system as claimed in claim 1, wherein each concentrator unit defines a plurality of RF communication channels over which communication between the concentrator unit and the meters in the corresponding meter group occurs.

4. A system as claimed in claim 3, wherein each meter in a meter group is assigned a predetermined channel defined by the corresponding concentrator unit for communication therewith.

5. A system as claimed in claim 3 or 4 wherein each meter in a meter group is operable to communicate with the corresponding concentrator unit at predetermined time intervals.

6. A system as claimed in claim 3 or 4 wherein at least one of the remote meters (1) is operable to receive transmissions from the associated concentrator unit (2), such transmissions relating to changes in operating conditions of the meter concerned.

7. A system as claimed in claim 3 or 4 wherein meter data is stored in a non-volatile memory in the remote meter concerned.

8. A system as claimed in claim 3 or 4, wherein at least one concentrator unit is operable to receive signals from additional units other than the remote meters in the group, and to transfer those other signals to other predefined central control units.

9. A system as claimed in claim 8, wherein the additional units provide security or fire systems.

10. A remote metering system comprising:

a plurality of remote meters each of which includes an antenna, a transmitter for transmitting meter signals via the antenna, a receiver connected to the antenna for receiving and filtering an incoming radio frequency signal, and a carrier signal detection circuit which is connected to receive the filtered radio frequency signal and which is operable to detect the presence or absence of a carrier signal, and to prevent activation of the transmitter in response to the presence of a carrier signal, or to activate the transmitter in response to the absence of said carrier signals;

a plurality of concentrator units arranged for direct RF communication with respective groups of remote meters to receive respective meter data therefrom; and a central control unit arranged for communicating with the plurality of concentrator units for receiving meter data from the plurality of concentrator units, wherein the remote meters in a meter group are operable to initiate communication with the corresponding concentrator unit during respective predefined time periods;

wherein the receiver is provided with a local oscillator signal by the transmitter (116), the transmitter (116) output being isolated from the antenna (120) during such provision of the local oscillator signal; and wherein, if the remote meter is an electricity meter, the antenna is provided by power supply lines, or, if the remote meter is a water meter, the antenna is provided by the sensor lines of the meter.

11. A remote metering system comprising:

a plurality of remote meters each of which includes an antenna, a transmitter for transmitting meter signals via the antenna, a receiver connected to the antenna for receiving and filtering an incoming radio frequency signal, and a carrier signal detection circuit which is connected to receive the filtered radio frequency signal and which is operable to detect the presence or absence of a carrier signal, and to prevent activation of the transmitter in response to the presence of a carrier signal, or to activate the transmitter in response to the absence of said carrier signals;

a plurality of concentrator units arranged for direct RF communication with respective groups of remote meters to receive respective meter data therefrom; and a central control unit arranged for communicating with the plurality of concentrator units for receiving meter data from the plurality of concentrator units, wherein the remote meters in a meter group are operable to initiate communication with the corresponding concentrator unit during respective predefined time periods;

wherein the receiver is provided with a local oscillator signal by the transmitter (116), the transmitter (116) output being isolated from the antenna (120) during such provision of the local oscillator signal; and wherein each remote meter is an electricity meter, the antenna of each meter being provided by the supply lines of the meter.

* * * * *

UNITED STATES PATENT AND TRADEMARK OFFICE

CERTIFICATE OF CORRECTION

PATENT NO. : 6,737,985 B1 
DATED : May 18, 2004
INVENTOR(S) : Peter Garrard and Peter Hibbitt It is certified that error appears in the above-identified patent and that said Letters Patent is hereby corrected as shown below:

Title page,
Item [56], References Cited, U.S. PATENT DOCUMENTS, delete
"4,173,837 A * 11/1979 Kiejzik" and insert
-- 4,713,837 A * 12/1987 Gordon --

Signed and Sealed this

Eleventh Day of January, 2005

JON W. DUDAS
*Director of the United States Patent and Trademark Office*